United States Patent [19]

Helfont

[11] 4,010,701

[45] Mar. 8, 1977

[54] SEWING MACHINE ACCESSORY

[76] Inventor: Raymond Helfont, 152-28 Jewel Ave., Flushing, N.Y. 11367

[22] Filed: Oct. 30, 1975

[21] Appl. No.: 627,143

[52] U.S. Cl. ..... 112/121.12; 112/121.15; 112/148; 112/150; 112/235

[51] Int. Cl.[2] ..... D05B 21/00; D05C 9/04

[58] Field of Search ..... 112/121.15, 121.12, 112/150, 151, 153, 235, 102, 136, 148

[56] References Cited

UNITED STATES PATENTS

| | | | |
|---|---|---|---|
| 1,197,112 | 9/1916 | Eberley | 112/121.12 |
| 2,355,023 | 8/1944 | Wiren | 112/121.12 |
| 2,880,683 | 4/1959 | Abel | 112/121.12 |
| 3,433,192 | 3/1969 | Pingitore et al. | 112/235 |
| 3,680,508 | 8/1972 | Baig et al. | 112/121.12 |

*Primary Examiner*—Werner H. Schroeder
*Assistant Examiner*—Peter Nerbun
*Attorney, Agent, or Firm*—Daniel Jay Tick

[57] ABSTRACT

An independent guide device is positionable on the supporting surface of the plate and in intermittent contact with the feeder of a sewing machine for guiding the needle of the machine in an irregular pattern. The guide device comprises a pair of complementary jig devices shaped to fit in juxtaposition with layers of material to be sewn to each other positioned between the jig devices. The jig devices have the same irregular configuration and complementary cross-sectional areas. Clamping devices releasably clamp the jig devices in juxtaposition with the material to be sewn positioned therebetween. Guide members extend from the foot device of the sewing machine for maintaining the guide device in a predetermined position relative to the needle of the machine while the guide device is moved between the foot device and the supporting surface of the feeder of the machine through the entire duration of the guide device.

10 Claims, 14 Drawing Figures

SEWING MACHINE ACCESSORY

BACKGROUND OF THE INVENTION:

The present invention relates to a sewing machine accessory. More particularly, the invention relates to a sewing machine accessory for sewing at least two layers of material to each other in an irregular pattern with a sewing machine.

It is impossible to sew an irregular pattern on a sewing machine in an identical manner, repetitively, without mechanical assistance. Furthermore, the process is time consuming, since it necessitates the painstaking efforts of following a mechanical device and the initial preparation of such a device, which is either an outline imprinted on the goods to be sewn or a mechanical outline.

When an outline is imprinted on the goods, the operator of the sewing machine must be very careful in following such outline, and unless he or she is highly skilled, the process is very slow and often produces inaccuracies.

When a mechanical guide such as, for example, a template, is used, the operator must be specially trained in the use of the guide and must be even more careful in following the guide than in the case of use of an imprinted outline. The process is thus even slower than that of following a printed outline and results in even more inaccuracies.

The principal object of the invention is to provide a sewing machine accessory for sewing an irregular pattern very rapidly.

An object of the invention is to provide a sewing machine accessory of simple structure, which is inexpensive in manufacture and is usable by anyone, with or without skill, and with negligible training, for sewing an irregular pattern very rapidly.

Another object of the invention is to provide a sewing machine accessory of simple structure, which is usable with facility, convenience and rapidity by anyone familiar with sewing machines, to sew an irregular pattern, repetitively, to produce thousands of identical patterns of sewn goods, in a very short time.

Still another object of the invention is to provide a sewing machine accessory which is adpated, with facility, convenience and rapidity, for use with new and existing sewing machines, and sews an irregular pattern with rapidity and accuracy, any desired number of times.

Yet another object of the invention is to provide a sewing machine accessory of simple structure, which requires little or no maintenance, and functions efficiently, effectively and reliably to sew an irregular pattern at high speed and with great accuracy.

BRIEF SUMMARY OF THE INVENTION:

In accordance with the invention, a sewing machine accessory for sewing at least two layers of material to each other in an irregular pattern with a sewing machine having a plate with a supporting surface having a hole formed therein, a feeder having a high friction surfaces positioned in the hole and having an intermittent motion relative to the surface of the plate, a needle and a foot device for pressing material to be sewn onto the supporting surface of the plate and guiding the needle through such material in a selected pattern, comprises independent guide means. The independent guide means is positionable on the supporting surface of the plate and in intermittent contact with the feeder of a sewing machine for guiding the needle of the machine in an irregular pattern. The guide means comprises a pair of complementary jig devices shaped to fit in substantial juxtaposition with layers of material to be sewn to each other positioned between the jig devices. The jig devices have substantially the same irregular configuration and complementary cross-sectional areas. Clamping means releasably clamp the jig devices in substantial juxtaposition with the material to be sewn positioned therebetween. Guide member means extend from the foot device of a sewing machine for maintaining the guide means in a predetermined position relative to the needle of the machine while the guide means is moved between the foot device and the supporting surface of the plate of the machine through the entire duration of the guide means.

Transport means is mounted on the foot device and contacts the guide means for facilitating movement of the guide means past the foot device. The transport means comprises friction reducing means.

The transport means comprises roller means rotatably mounted on the foot device and adapted to roll on the guide means. The roller means comprises a plurality of rollers rotatably mounted in spaced substantially parallel relation with each other.

One of the pair of complementary jig devices of the guide means comprises substantially rigid material having a substantially triangular cross-sectional area and is utilized as the bottom one of the jig devices. The other of the pair of complementary jig devices comprises substantially rigid material having a substantially rectangular cross-sectional area with a channel formed therein of substantially the same configuration and dimensions as the cross-sectional area of the one of the pair of complementary jig devices and is utilized as the top one of the jig devices.

Each of the pair of complementary jig devices of the guide means comprises a substantially rod-like member bent over on itself to form an irregular pattern in an endless extension.

Each of the complementary jig devices of the guide means has notches formed therein in spaced relation to each other. The clamping means comprises a plurality of spring clip members each comprising a band of resilient material of substantially U-shaped configuration adapted to releasably fit in the notches formed in the complementary jig devices and releasably clamp the jig devices in substantial juxtaposition with the material to be sewn positioned therebetween.

The triangular cross-sectional area of the one of the complementary jig devices has a base and a pair of sides. One of the sides is shorter in extent from the base to the vertex of the traingular area than the other side and forms a greater angle with the base than the other side. The cross-sectional channel of the other of the complementary jig devices has one side shorter in extent from an imaginary base side of the rectangular cross-sectional area to the vertex of the channel than the other side and forms a greater angle with the base than the other side. The one side of the triangular cross-sectional area and the one side of the cross-sectional channel are substantially equal to each other in extension and angle. The other side of the triangular cross-sectional area and the other side of the cross-sectional channel are substantially equal to each other in extension and angle. The rectangular cross-sectional area of the other of the complementary jig devices has a top base side spaced from and parallel to the imaginary base side, one side extending between the top base side and the one side of the cross-sectional channel and another side extending between the top base side and the other side of the cross-sectional channel. The one side of the rectangular cross-sectional area is shorter in extent than the other side.

BRIEF DESCRIPTION OF THE DRAWINGS:

In order that the invention may be readily carried into effect, it will now be described with reference to the accompanying drawings, wherein.

In the FIGS., the same components are identified by the same reference numerals.

Figure 13:
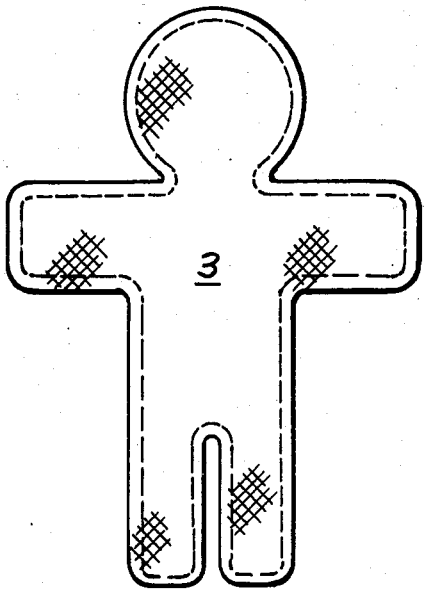
FIG. 13 is a top view of a pattern of goods prepared by the sewing machine accessory of the invention.

DETAILED DESCRIPTION OF THE INVENTION:

The sewing machine accessory of the invention is for sewing at least two layers material 1 and 2 (FIG. 10) to each other in an irregular pattern such as, for example, a pattern 3, shown in FIG. 13, with a sewing machine. The pattern 3 of FIG. 13 is stitched by the sewing machine in a pattern illustrated by broken lines.

Figure 1:
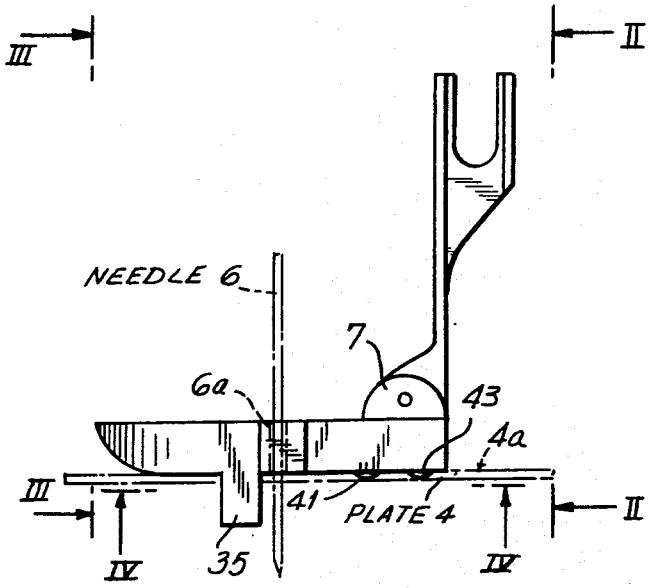
FIG. 1 is a side view of an embodiment of the foot device of the sewing machine accessory of the invention.
Figure 5:
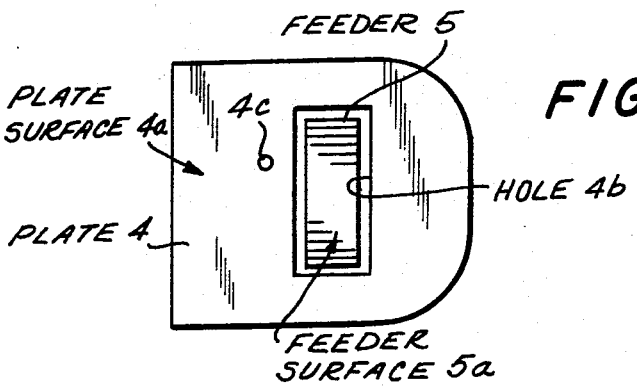
FIG. 5 is a view of an embodiment of a plate and feeder utilized with the sewing machine accessory of the invention.

The sewing machine has a plate 4, shown by broken lines in FIG. 1, with a supporting surface 4*a* (FIGS. 1 and 5). The plate 4 has a hole 4*b* formed therein (FIG. 5). A feeder 5 having a high friction surface 5*a* such as, for example, rubber, or ridged rubber, or the like, is positioned in the hole 4*b* and has an intermittent motion relative to the surface 4*a* of the plate 4 (FIG. 5). The motion is imparted to the feeder 5 in the usual manner, via a cam. The sewing machine also has a needle 6, shown by broken lines in FIG. 1 and by a solid line in FIG. 4, and a foot device 7 (FIGS. 1 to 4). The needle 6 passes through a bore 6*a* formed through the foot device 7 (FIGS. 1 to 4) and a bore 4*c* formed through the plate 4 (FIG. 5). The foot device 7 presses material to be sewn onto the supporting surface 4*a* of the plate 4 and in intermittent contact with the feeder 5 guides the needle 6 through such material in a selected pattern such as, for example, that shown by broken lines in FIG. 13.

Figure 7:
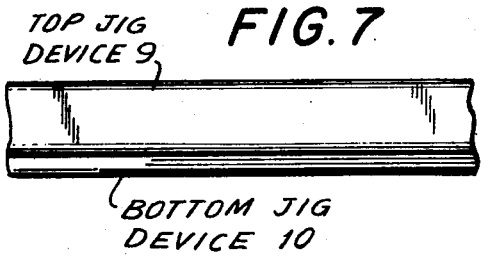
FIG. 7 is a view, on an enlarged scale, taken along the lines VII—VII, of FIG. 6.
Figure 8:
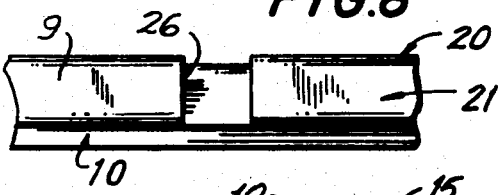
FIG. 8 is a view, on an enlarged scale, taken along the lines VIII—VIII, of FIG. 6.

The sewing machine accessory of the invention comprises an independent guide device 8 (FIG. 6) positionable on the supporting surface 4*a* of the plate 4 of a sewing machine for guiding the needle 6 of the machine in an irregular pattern. The configuration of the guide device 8 and that of the pattern 3 sewn by use thereof is for purely illustrative purposes and may be any desired configuration. The guide device 8 comprises a pair of complementary jig devices 9 and 10 (FIGS. 7, 8 and 10) shaped to fit in substantial juxtaposition with the layers of material 1 and 2 to be sewn to each other positioned between said jig devices, as shown in FIG. 10.

Figure 11:
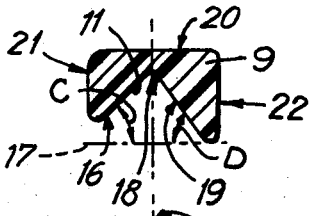
FIG. 11 is a cross-sectional view of the top jig device of the embodiment of the guide device of FIG. 6.
Figure 12:
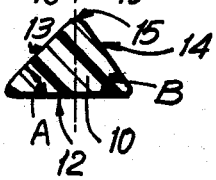
FIG. 12 is a cross-sectional view of the bottom jig device of the embodiment of FIG. 6 of the guide device.
Figure 10:
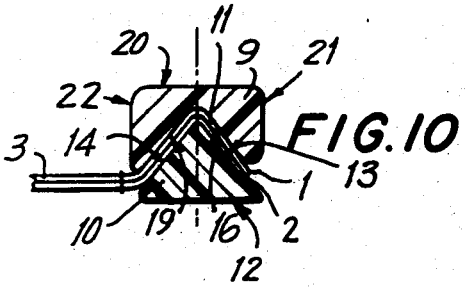
FIG. 10 is a cross-section exploded view, on an enlarged scale, taken along the lines X—X, of FIG. 1.

The complementary top and bottom jig devices 9 and 10, respectively, have substantially the same irregular configuration and complementary cross-sectional areas, as shown in FIGS. 10, 11 and 12. The bottom jig device 10 comprises substantially rigid material such as, for example, lightweight metal, such as, for example, magnesium, aluminum, or the like, or plastic, or the like, and has a substantially triangular cross-sectional area (FIGS. 10 and 12). The top jig device 9 comprises the same material as the bottom jig device 10 and has a substantially rectangular cross-sectional area with a channel 11 formed therein substantially of the same configuration and dimensions as the cross-sectional area of said bottom jig device (FIGS. 10 and 11).

Each of the pair of complementary jig devices 9 and 10 of the guide device 8 comprises a substantially rod-like member bent over on itself to form the irregular pattern 3, or any desired irregular pattern, in an endless extension.

The triangular cross-sectional area of the complementary jig device 10 has, as shown in FIGS. 10 and 11, a base 12 and a pair of sides 13 and 14. The side 13 is shorter in extent from the base 12 to the vertex 15 of the triangular area (FIG. 12) than the side 14 and forms a greater angle A with said base than the angle formed by the side 14 with said base (FIG. 12).

The cross-sectional channel 11 of the complementary jig device 9 has one side 16 shorter in extent from an imaginary base side 17 of the rectangular cross-sectional area, shown by broken lines in FIG. 11, to the vertex 18 of the channel than the other side 19, as shown in FIG. 11. The side 16 of the channel 11 forms a greater angle C with the imaginary base side 17 than the angle D formed by the side 19 with said imaginary base side, as shown in FIG. 11.

The side 13 of the triangular cross-sectional area and the side 16 of the cross-sectional channel 11 are substantially equal to each other in extension and angle; the angles A and C being substantially equal. The side 14 of the triangular cross-sectional area and the side 19 of the cross-sectional channel 11 are substantially equal to each other in extension and angle; the angles B and D being substantially equal.

The rectangular cross-sectional area of the top jig device 9 has, as shown in FIG. 11, a top base side 20 spaced from and parallel to the imaginary base side 17, a side 21 extending between said top base side and the side 16 of the cross-sectional channel 11, and a side 22 extending between said top base side and the side 19 of said cross-sectional channel. The side 21 of the rectangular cross-sectional area is shorter in extent than the side 22 thereof, as shown in FIGS. 10 and 11.

Figure 6:
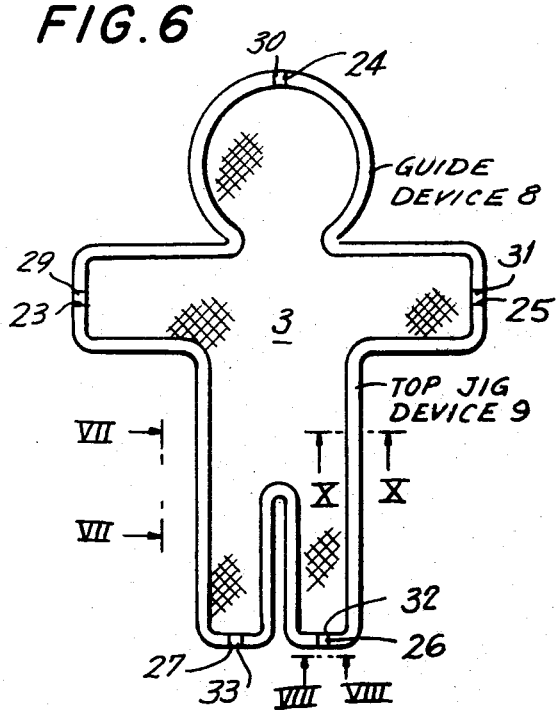
FIG. 6 is a top view of an embodiment of the guide device of the sewing machine accessory of the invention.
Figure 9:
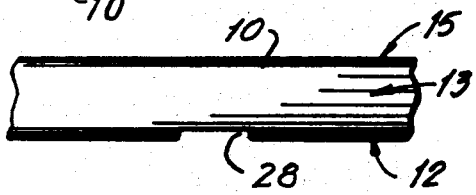
FIG. 9 is a side view, on an enlarged scale, of the bottom jig device of the embodiment of the guide device of FIG. 6.

Each of the complementary jig devices 9 and 10 of the guide device 8 has notches formed therein in spaced relation to each other. Thus, the top jig device 9 has a plurality of notches 23, 24, 25, 26 and 27, as shown in FIG. 6. The bottom jig device 10 has an equal number of notches, similarly positioned to those of the top jig device 9, of which notches, only a notch 28 is shown in FIG. 9.

Figure 14:
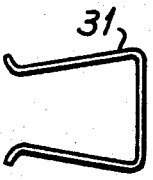
FIG. 14 is a side view of an embodiment of a clamp of the jig devices of the sewing machine accessory of the invention.

A plurality of clamps or spring clip members, are provided and are adapted to releasably fit in the notches formed in the complementary jig devices 9 and 10 and releasably clamp said jig devices in substantial juxtaposition, with the material to be sewn positioned therebetween. Spring clip members 29, 30, 31, 32 and 33 are releasably fitted in the notches 23 to 27, respectively, of the top jig device 9 and the corresponding notches of the bottom jig device 10. A typical clamp or spring clip 31 is shown in FIG. 14. As shown in FIG. 14, each spring clip comprises of band of resilient material of any suitable type such as, for example, spring steel, of substantially U-shaped configuration adapted to releasably fit in the notches formed in complementary jig devices 9 and 10.

Figure 2:
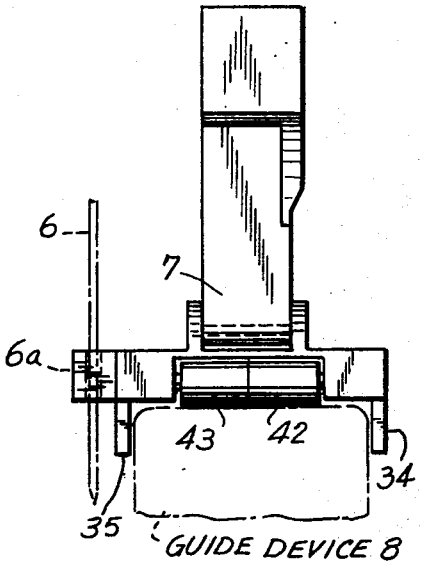
FIG. 2 is a rear view, taken along the lines II—II, of FIG. 1.
Figure 3:
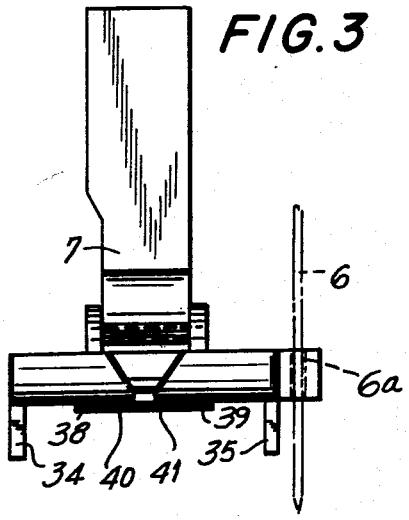
FIG. 3 is a front view, taken along the lines III—III, of FIG. 1.
Figure 4:
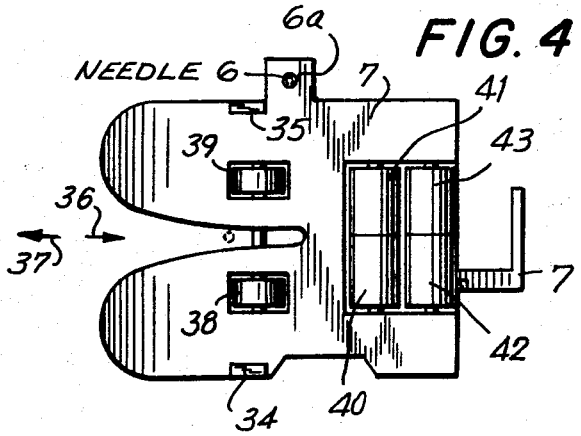
FIG. 4 is a bottom view, taken along the lines IV—IV, of FIG. 1.

Guide member devices 34 and 35 are provided and extend from the foot device 7 of a sewing machine, as shown in FIGS. 1 to 4. The guide member devices 34 and 35 maintain the guide device 8 in a predetermined position relative to the needle 6 of the sewing machine while the guide device is moved between the foot device and the supporting surface 4*a* of the plate 4 of the sewing machine through the entire duration of said guide device. In other words, as shown in FIG. 2, the guide members 34 and 35 maintain the guide device 8 between them, so that said guide device is freely movable in directions of arrows 36 and 37 of FIG. 4, whereas said guide device is restricted in movement in other directions.

Transport devices are mounted on the foot device 7 and contact the guide device 8 for facilitating movement of said guide device past said foot device. The transport devices comprise friction reducing devices such as, for example, low-friction material such as, for example, Teflon, covering the contacting surfaces of the foot device 7 and the guide device 8 or either, or rollers, or the like.

In the illustrated embodiment of the invention, the transport device comprises a plurality of rollers 38, 39 (FIGS. 3 and 4), 40, 41 (FIG. 4), 42 and 43 (FIGS. 2 and 4) rotatably mounted on the foot device 7 and adapted to roll on the guide device 8. The rollers 38 to 43 are mounted in spaced substantially parallel relation with each other.

While the invention has been described by means of a specific example and in a specific embodiments, I do not wish to be limited thereto, for obvious modifications will occur to those skilled in the art without departing from the spirit and scope of the invention.

I claim:

1. A sewing machine accessory for sewing at least two layers of material to each other in an irregular pattern with a sewing machine having a plate with a supporting surface having a hole formed therein, a feeder having a high friction surface positioned in the hole and having an intermittent motion relative to the surface of the plate, a needle and a foot device for pressing material to be sewn onto the supporting surface of the plate and guiding the needle through such material in a selected pattern, said sewing machine accessory comprising independent guide means positionable on the supporting surface of the plate and in intermittent contact with the feeder of a sewing machine for guiding the sewn material through an irregular pattern, said guide means comprising a pair of complementary jig devices shaped to fit in substantial juxtaposition with layers of material to be sewn to each other positioned between said jig devices, said jig devices having substantially the same irregular configuration and complementary cross-sectional areas, one of the pair of complementary jig devices comprising a frame of substantially rigid material having a cross-sectional area of predetermined geometric configuration and being utilized as the bottom one of said jig devices and the other of said pair of complementary jig devices comprising substantially rigid material having a cross-sectional area of predetermined configuration with a channel formed therein of substantially the same configuration and dimensions as the cross-sectional area of said one of said pair of complementary jig devices and being utilized as the top one of said jig devices, and clamping means for releasably clamping the jig devices in substantial juxtaposition with the material to be sewn positioned therebetween; and guide member means extending from the foot device of a sewing machine for maintaining the guide means in a predetermined position relative to the needle of the machine while said guide means is moved between the foot device and the supporting surface of the feeder of the machine through the entire duration of said guide means.

2. A sewing machine accessory as claimed in claim 1, further comprising transport means mounted on said foot device and contacting said guide means for facilitating movement of said guide means past said foot device.

3. A sewing machine accessory as claimed in claim 1, wherein one of the pair of complementary jig devices of the guide means comprises substantially rigid material having a substantially triangular cross-sectional area and is utilized as the bottom one of said jig devices and the other of said pair of complementary jig devices comprises substantially rigid material having a substantially rectangular cross-sectional area with a channel formed therein of substantially the same configuration and dimensions as the cross-sectional area of said one of said pair of complementary jig devices and is utilized as the top one of said jig devices.

4. A sewing machine accessory as claimed in claim 1, wherein each of the pair of complementary jig devices of the guide means comprises a substantially rod-like member bent over on itself to form an irregular pattern in an endless extension.

5. A sewing machine accessory as claimed in claim 1, wherein each of the complementary jig devices of the guide means has notches formed therein in spaced relation to each other, and said clamping means comprises a plurality of spring clip members each comprising a band of resilient material of substantially U-shaped configuration adapted to releasably fit in the notches formed in said complementary jig devices and releasably clamp said jig devices in substantial juxtaposition with the material to be sewn positioned therebetween.

6. A sewing machine accessory as claimed in claim 2, wherein the transport means comprises friction reducing means.

7. A sewing machine accessory as claimed in claim 2, wherein the transport means comprises roller means rotatably mounted on the foot device and adapted to roll on said guide means.

8. A sewing machine accessory as claimed in claim 3, wherein the triangular cross-sectional area of said one of said complementary jig devices has a base and a pair of sides, one of the sides being shorter in extent from the base to the vertex of the triangular area than the other side and forming a greater angle with said base than the other side.

9. A sewing machine accessory as claimed in claim 7, wherein said roller means comprises a plurality of rollers rotatably mounted in spaced substantially parallel relation with each other.

10. A sewing machine accessory as claimed in claim 8, wherein the cross-sectional channel of said other of said complementary jig devices has one side shorter in extent from an imaginary base side of the rectangular cross-sectional area to the vertex of the channel than the other side and forming a greater angle with said base than the other side, the one side of said triangular cross-sectional area and the one side of said cross-sectional channel being substantially equal to each other in extension and angle, the other side of said triangular cross-sectional area and the other side of said cross-sectional channel being substantially equal to each other in extension and angle, said rectangular cross-sectional area of said other of said complementary jig devices having a top base side spaced from and parallel to the imaginary base side, one side extending between said top base side and said one side of said cross-sectional channel and another side extending between said top base side and said other side of said cross-sectional channel, said one side of said rectangular cross-sectional area being shorter in extent than the other side.

* * * * *